US008585313B2

(12) United States Patent
Wojøtowicz et al.

(10) Patent No.: US 8,585,313 B2
(45) Date of Patent: Nov. 19, 2013

(54) POST COUPLER

(75) Inventors: David J. Wojøtowicz, Orland Park, IL (US); Anthony J. Troyner, Shorewood, IL (US); James E. Collins, Munster, IN (US)

(73) Assignee: Edsal Manufacturing Co., Inc., Chicago, IL (US)

( * ) Notice: Subject to any disclaimer, the term of this patent is extended or adjusted under 35 U.S.C. 154(b) by 0 days.

(21) Appl. No.: 11/044,689

(22) Filed: Jan. 27, 2005

(65) Prior Publication Data

US 2006/0163438 A1 Jul. 27, 2006

(51) Int. Cl.
*F16B 7/00* (2006.01)
*F16B 12/36* (2006.01)
*F16B 13/00* (2006.01)

(52) U.S. Cl.
USPC ... 403/293; 403/109.2; 403/295; 248/220.22; 248/300; 211/192; 52/848

(58) Field of Classification Search
USPC ..... 403/109.2, 109.8, 286, 283, 393, 353, 403/292, 293, 295, 300; 211/194, 182, 211/189–192; 52/582.1, 848; 256/47, 256/DIG. 5; 248/174, 188, 220.21, 220.22, 248/300
See application file for complete search history.

(56) References Cited

U.S. PATENT DOCUMENTS 1,458,666 A * 6/1923 Stoppello ..... 403/305
2,226,763 A * 12/1940 Geib et al. ..... 446/116
2,296,336 A * 9/1942 Crozier ..... 405/251
2,367,206 A * 1/1945 Davis ..... 29/421.2
3,056,507 A * 10/1962 Squires, Jr. et al. ..... 108/106
RE27,200 E * 10/1971 Ferdinand et al. ..... 211/190
3,788,001 A * 1/1974 Balfanz, Jr. ..... 47/33
4,598,512 A * 7/1986 Chapman ..... 52/165
4,967,916 A * 11/1990 Handler et al. ..... 211/187
5,395,093 A * 3/1995 Chrisman ..... 256/47
5,423,576 A * 6/1995 Hunter ..... 285/288.1
5,971,175 A * 10/1999 Bustos ..... 211/187
6,209,155 B1 * 4/2001 Epstein et al. ..... 5/201
6,397,413 B2 * 6/2002 Epstein et al. ..... 5/201
6,839,920 B2 * 1/2005 Schulte ..... 5/200.1

FOREIGN PATENT DOCUMENTS

DE 29808396 U1 8/1998

OTHER PUBLICATIONS

Wetterberg, US2002/O171338 A1, Patent Appln Publication.
International Search Report for PCT Application S/N PCT/US2005/002581, completed on May 25, 2005, mailed on Jun. 2, 2005.
Written Opinion of International Searching Authority for PCT Application Serial No. PCT/US2005/002581, mailed on Jun. 2, 2005.

* cited by examiner

*Primary Examiner* — Gregory Binda
*Assistant Examiner* — Nahid Amiri
(74) *Attorney, Agent, or Firm* — Wood, Herron & Evans, LLP

(57) ABSTRACT

A coupler for coupling two posts end-to-end has ninety degree flanges and two reverse wrap ends. The coupler is slid one-half way over the ends of one formed post, comprising two flanges, with the reverse wrap holding the post flanges. Another flanged post is inserted into the coupler to engage the end of the first post, the coupler holding the posts end-to-end. An alternate embodiment coupler is disclosed.

15 Claims, 5 Drawing Sheets

POST COUPLER

Benefit of the filing date of Jan. 30, 2004 of United States provisional patent application Ser. No. 60/540,935 is claimed. That application is incorporated herein in its entirety by this express reference.

This invention relates to post couplers and in particular to couplers for coupling together the ends of two posts vertically oriented with respect each other, the lower end of an upper post resting on the upper end of a lower post in vertical orientation.

Corner posts used, for example, in shelving are made from any suitable material, such as steel, and are typically formed of relatively thin sheet metal with two flanges disposed in an angular configuration, such that one flange of the post is oriented generally at ninety degrees to the other flange. These flanges may be either of a single layer of post material or may comprise two layers bent back on themselves for a somewhat thicker or more rigid post, than a post made from single layer flanges of the same material, for example.

It is desired to provide posts in certain varied lengths to satisfy varied needs. A particular application may require a corner post of a height in excess of a standard length, requiring one post to be set onto another for the overall length desired. Accordingly, it is desired to provide a way to couple the ends of two posts together to form a unitary structure with one post vertically oriented on top of another.

Another objective of the invention has been to provide an improved simple post coupler easily fitted to respective ends of two posts for coupling said ends together to form a unitary post.

To these ends, one preferred embodiment of a post coupler according to the invention comprises a coupler having two flanges disposed generally at 90 degrees to each other, or at approximately the same angle as the flanges of the angular formed corner posts with which the coupler will be used. The flanges of the couple each have turned back a reverse fold edges or return flanges disposed along one side of the respective flanges, with a gap therebetween.

In use, the coupler is slid over the flanges of one post to be coupled, preferably to about one-half the coupler length. The other post is slid into the coupler so the reverse fold flanges of the coupler capture the edges of the respective post flanges, coupling the two posts together, end to end. The coupling thus facilitates assembly of a unitary post, longer in length than the two original posts, and highly useful in a wide variety of applications, such as in shelving, enclosures and other environments.

Details on the coupler serve to frictionally engage one or both post ends to secure the coupler in longitudinal position with respect to the longitudinal extent of one or both posts.

The coupler may be apertures or holes for receiving fasteners through the shelf or other handling holes of the posts in order to fasten the couplers onto the posts and strengthen the coupled joint.

In an alternative embodiment, the post flanges are formed with return flanges and the couple is preferably of single layer sheet metal material. The coupler is inserted into the gaps formed by the return flanges of the post with its major flanges, and with an end extending therefrom for disposition within the end of a complimentary post.

Detents for positioning and apertures for optional fasteners can also be provided in this alternate coupler.

The post couplers provide simple efficient coupling joints at the complimentary ends of two posts to provide a unitary post of desired length.

These and other objects and advantages will become even more readily apparent from the following detailed description and from the drawings in which.

Figure 1:
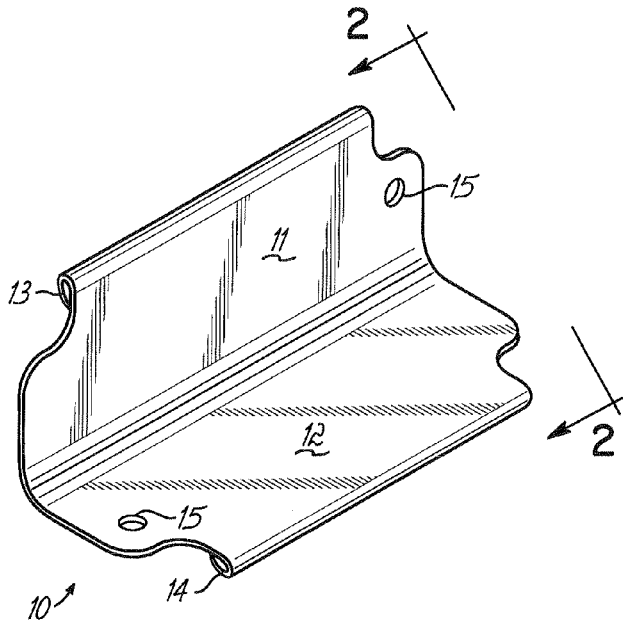
FIG. 1 is a perspective view of one embodiment of the coupler invention.
Figure 3:
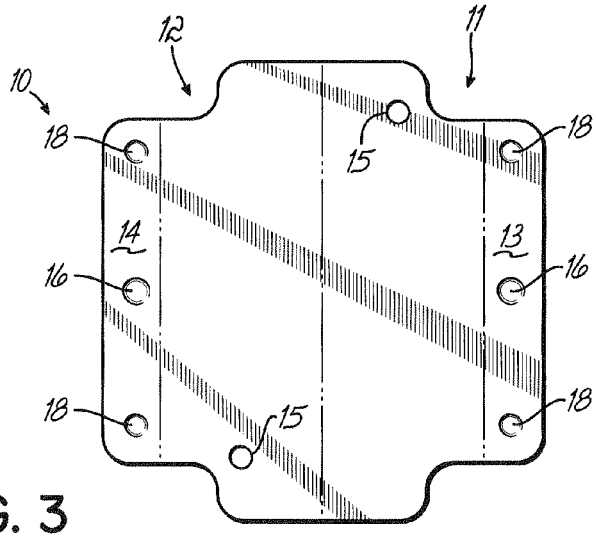
FIG. 3 is a plan view of the developed coupler of FIG. 1.

The present invention contemplates two different embodiments for coupling such posts together. In a first embodiment (FIGS. 1-5), a coupler 10 is provided for a formed post with segments $P_1$ and $P_2$, each segment having two flanges 20*a*, 20*b* and 21*a*, 21*b*, respectively, essentially oriented at ninety degrees (shown) or some other useful angle with respect to each other. To this end, a coupler 10 is shown in FIG. 1 in its completed configuration.

Figure 2:
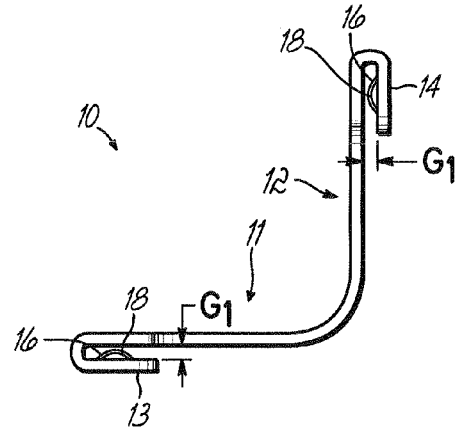
FIG. 2 is an end view taken along lines 2-2 of FIG. 1.
Figure 2A:
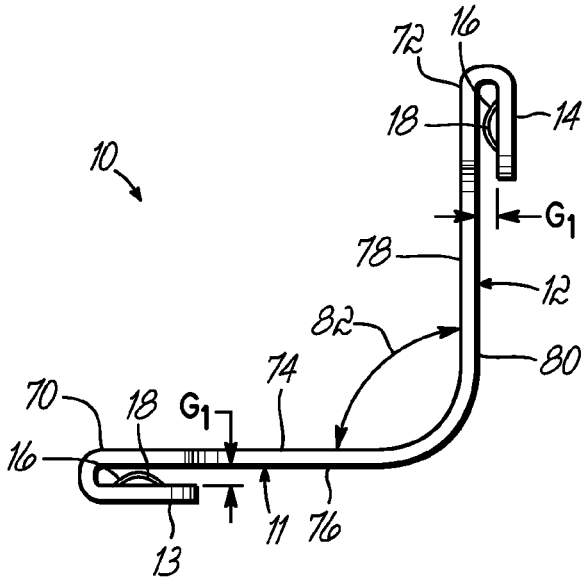
FIG. 2A is an end view, the same as FIG. 2, further identifying the features of the illustrated coupler.

The coupler 10 has two flanges 11, 12 oriented at ninety degrees (shown) with respect to each other or at some other useful angle consistent with the orientation of the post flanges. Coupler 10 further includes reverse bend flanges 13, 14, extending from an end 70, 72 of the respective flanges 11, 12 and reverse folded back parallel alongside the respective flanges 11, 12 as shown in the FIGS. 1 and 2 and with a gap "$G_1$" therebetween. As shown in FIG. 2A, flange 11 has an interior surface 74 and an outside surface 76 and flange 12 has an interior surface 78 and an outside surface 80. The interior surfaces 74 and 78, of flanges 11 and 12 respectively, define an included angle 82 therebetween. The included angle 82 can be ninety degrees or some other useful angle consistent with the orientation of the post flanges. The outside surface 76 of flange 11 faces the reverse bend flange 13 and the outside surface 80 of flange 12 faces the reverse bend flange 14.

Figure 4:
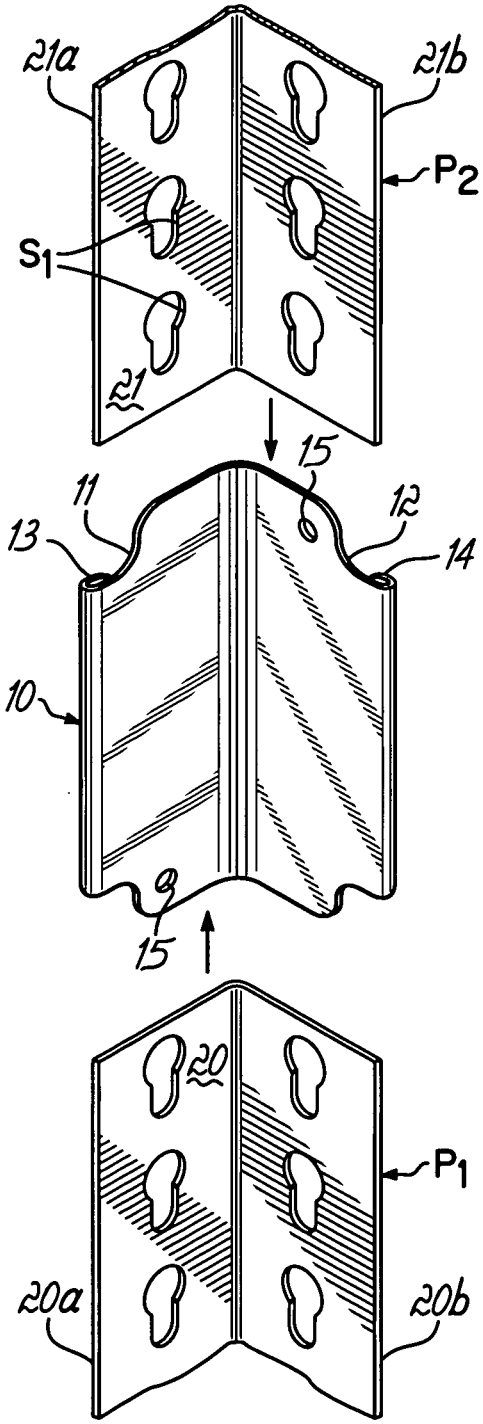
FIG. 4 is an exploded perspective view illustrating orientation of the coupler of FIG. 1 with two posts.
Figure 5:
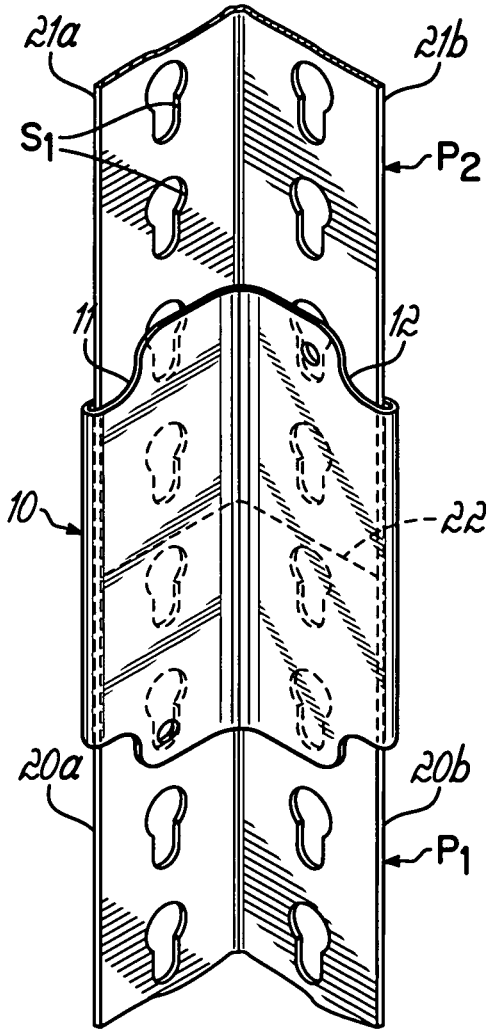
FIG. 5 is a perspective view of a unitary post provided by the coupler of FIG. 1 coupling the two posts of FIG. 4.

FIG. 4 and FIG. 5 illustrate the use of the coupler 10. In FIG. 4, the upper end 20 of a lower post $P_1$ is oriented vertically and the coupler 10 is tapped down onto the upper end 20, approximately half its length, that is the vertical length of the coupler 10, so one end of the coupler operatively engages one post. Thereafter, the lower end 21 of an upper post $P_2$ is tapped into the coupler 10 until the lower end 21 of the upper post rests on the upper end 20 of the lower post $P_1$. Another end of the coupler operatively engages the other post at juncture 22. In this configuration, the flaps or flanges 13, 14 at the coupler ends, wrap around the ends of the upper and lower post ends 20, 21 and secure the posts $P_1$ and $P_2$ against lateral movement with respect to each other, forming a unitary post.

One or more holes 15 are optionally provided in coupler 10. Fasteners (not shown) are extended through these holes 15 and may be tightened to increase the strength, rigidity and integrity of the unitary post formed of coupled posts $P_1$, $P_2$. Where the posts $P_1$, $P_2$ are provided with slots "$S_1$" or other apertures (as shown in FIGS. 4-5), the holes 15 are preferably provided in coupler 10 so as to index with such slots to facilitate fastener application.

In addition, one or more detents 16 extending from a surface of coupler 10 for frictionally engaging the respective posts $P_1$, $P_2$ to hold the coupler 10 relative to them, respectively. Four additional shallower detents 18 may also be incorporated on opposite sides of the detents 16. These additional detents 18 could be used to also enhance engagement with the post segments $P_1$, $P_2$, but their shallower extension facilitates initial joining of the coupler 10 to a post segment.

Figure 6:
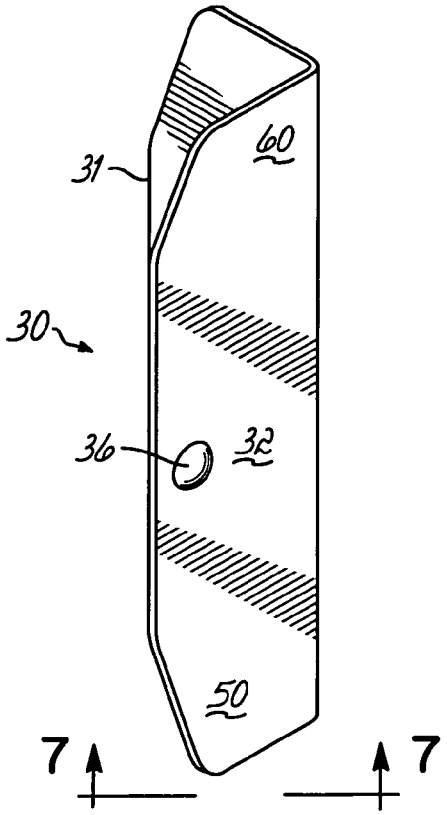
FIGS. 6, 7 and 8 are views of an alternate coupler according to the invention analogous to FIGS. 1, 2 and 3.
Figure 7:
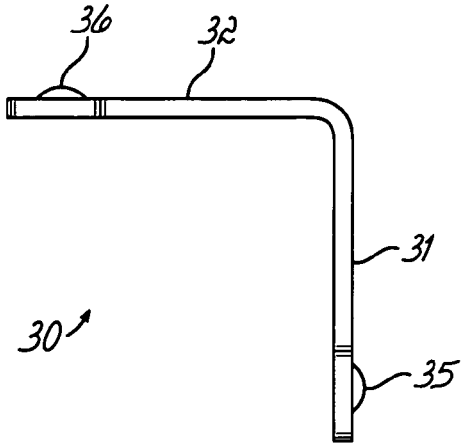
Figure 8:
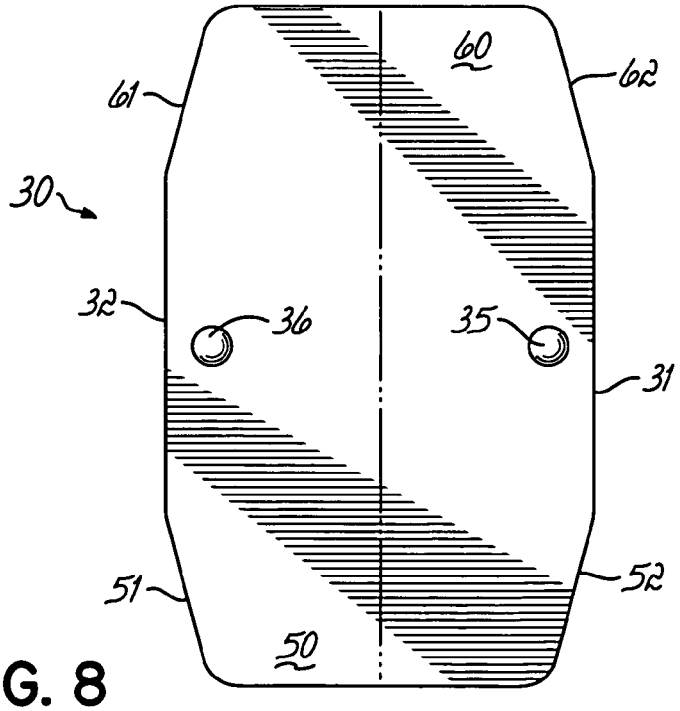

Another embodiment is shown in FIGS. 6-10. In FIG. 6, a coupler 30 has two flanges 31, 32 oriented approximately at ninety degrees (shown) with respect to each other, or at some other useful angle relative to the angle of the post flanges with which it will be used.

Detents at 35 and 36, respectively, are slight offsets, depressions or upsets formed in the material of the coupler 30 and extending from its major surface for the purpose of securing the coupler within the posts as will be described.

Figure 9:
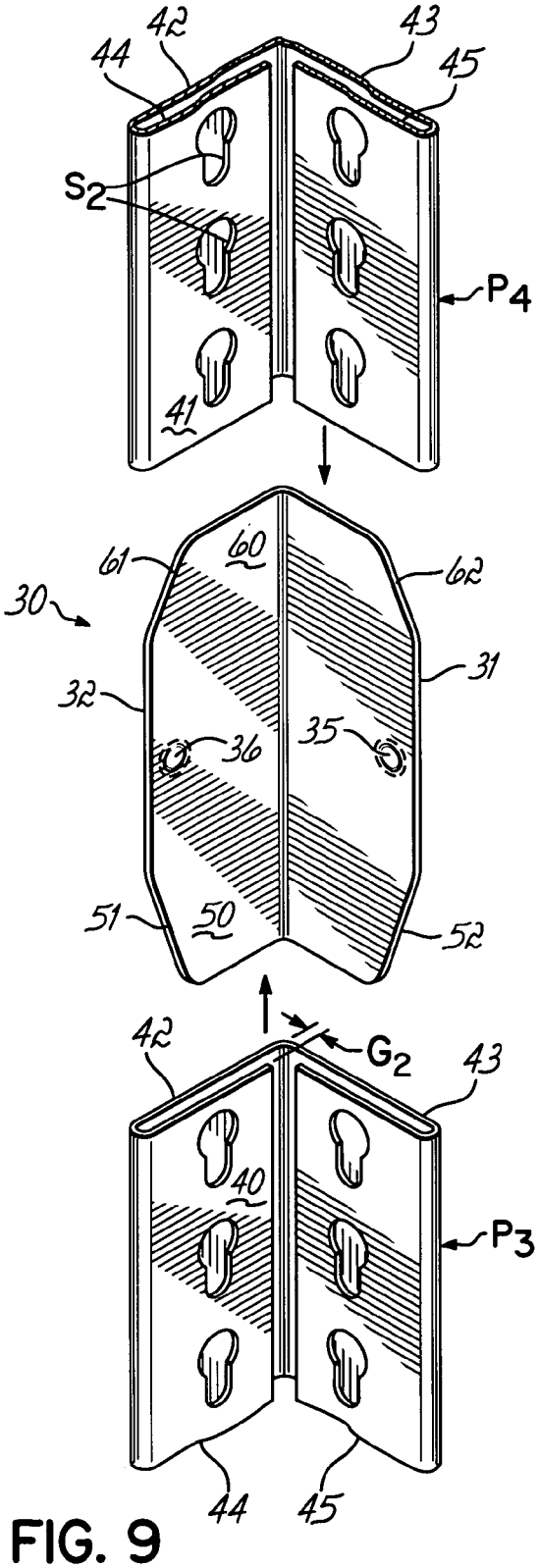
FIG. 9 is a perspective exploded view of the alternate coupler of FIG. 7 analogous to FIG. 4.
Figure 10:
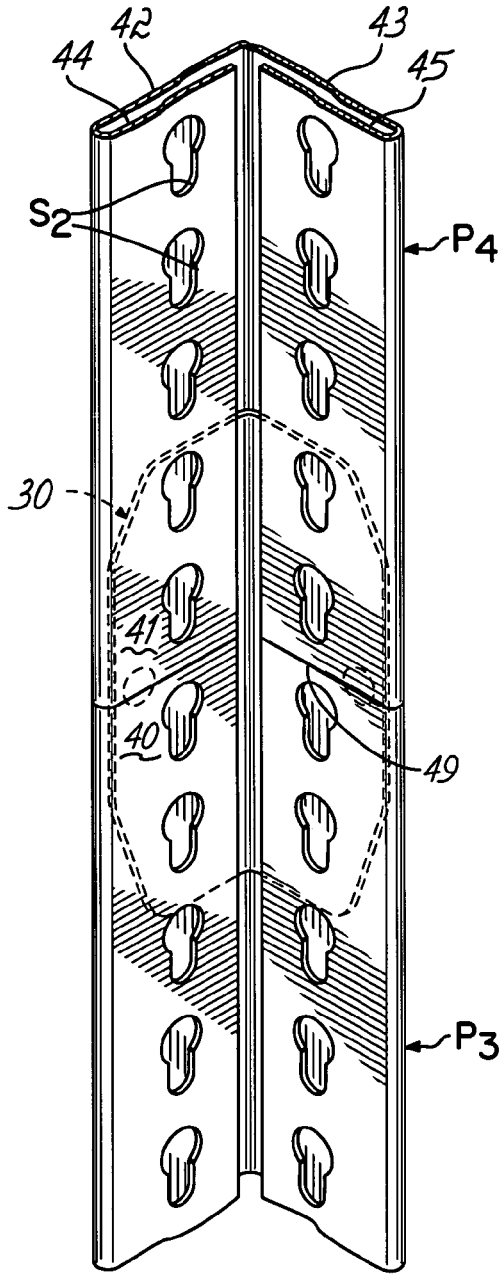
FIG. 10 is a perspective view of the alternate coupler in use, facilitating provision of a unitary post provided by the coupler of FIGS. 6-8 coupling the two posts of FIG. 9.

Looking now at FIGS. 9 and 10, a coupler 30 is utilized to couple two angularly formed posts $P_3$, $P_4$ together. Posts $P_3$, $P_4$ each include two flanges 42, 43 and two additional flanges, 44, 45, respectively reverse bent from flanges 42 and 43 to form a formed or structural post. A gap $G_2$ is formed between the respective reverse and major flanges.

It will be seen in FIG. 9 that the coupler 30 can be inserted into the upper end 40 of post $P_3$ with the flanges 31, 32 of the coupler 30 residing respectively between the parallel flange elements 42, 44 on one side of the post $P_3$ and parallel flange elements 43, 45 on the other side. In this condition, the coupler 30 is tapped down into the post $P_3$, about half the length of the coupler 30. An upper post $P_4$ is then slid over the coupler 30 so that the lower end 41 of the post $P_4$ adjoins the upper end 42 of the post $P_3$ at the juncture 49 (FIG. 10). See the coupler 30 shown in the dotted lines of FIG. 10.

In this manner, the posts $P_3$ and $P_4$ are held together, end-to-end, in vertical orientation with the dimples, detents or upsets 35, 36 in any suitable location in the middle of and/or at both upper and lower ends of the coupler 30, providing friction for holding the coupler 30 within the respective post flange elements of the respective posts $P_3$ and $P_4$.

Like in the first embodiment, it will be appreciated that each of the posts $P_3$, $P_4$ include a plurality of slots, such as keyhole slots "$S_2$" in FIGS. 9 and 10. These slots can be used, for example, for mounting brackets, shelving or other accessories on the upright post as may be desired.

Moreover, the coupler 30 has two respective ends 50, 60. Each end is tapered, as at end 50 with tapered edges 51, 52 and at end 60 with tapered edges 61, 62, to facilitate insertion of the coupler into the gaps defined by the respective flanges of the respective posts, and thus forming a unitary post.

These and other modifications and embodiments will become readily apparent to those of ordinary skill in the art without departing from the scope of the invention and applicant intends to be bound only by the claims appended hereto.

What is claimed is:

1. In a shelving unit, at least two angularly formed vertically oriented and aligned posts, each having two post flanges disposed at an angle to each other with each post flange having a thickness and an elongated edge, an end of one post proximate an end of another post, and a post coupler for coupling together ends of said posts, wherein said coupler comprises:

a pair of connected coupler flanges, each coupler flange having an interior surface defining an included angle with respect to the interior surface of the other coupler flange, and each coupler flange having an outside surface;

each one of said coupler flanges having a respective additional flange extending from and along end positions of said coupler flanges;

each said respective additional flange comprising a reverse bend flange extending alongside the respective coupler flange from which the respective reverse bend flange is extended and from proximate but short of one end of a coupler flange to proximate but short of another end thereof, the outside surface of the respective coupler flange facing the respective reverse bend flange;

at least one detent on each said reverse bend flange;

a gap defined by and between each said respective reverse bend flange and said outside surface of the respective coupler flange from which the reverse bend flange extends, said gap having a width approximately equal to said thickness of a single post flange, and less than twice the thickness of said single post flange and being sized to accept one of the flanges of a single one of the two angularly formed posts therein, wherein one end of the coupler is configured to receive one of the two angularly formed posts and the other end of the coupler is configured to receive the other one of the angularly formed posts to permit the two posts to be secured in an abutting, end-to-end vertically oriented relationship with one another;

said first and second end portions of said coupler flanges engaging respective flanges of said posts, with said reverse bend flanges of the coupler extending outwardly around edges of respective flanges of said two posts; and wherein said at least one detent on each reverse bend flange frictionally engages a respective post flange to hold said coupler in position on said angularly-formed posts.

2. A coupler as in claim 1 including at least one detent in one of said coupler flanges for securing said coupler in position on one of the angularly formed posts.

3. A shelving unit as in claim 1 wherein one end of said coupler is disposed over and around edges of the flanges of one of the angularly formed posts and another end of said coupler is disposed over and around edges of the flanges of the other one of the angularly formed posts for coupling the posts together.

4. The shelving unit as in claim 1 wherein said coupler comprises upper and lower end portions and wherein a portion of said coupler at each of said upper and lower end portions is free of said reverse bend flanges.

5. A composite post comprising:

a first angularly formed post member having at least two flanges disposed at an angle to each other, each flange having elongated edges;

a second angularly formed post member having at least two flanges disposed at an angle to each other, said second angularly formed post member being disposed in an abutting, end-to-end vertical relationship with said first angularly formed post member;

a coupler;

said coupler comprising a pair of connected coupler flanges, each having an interior surface defining an included angle with respect to the interior surface of the other flange, and each having an outside surface;

each one of the coupler flanges having a reverse bend flange extending from an edge portion thereof;

each said reverse bend flange extending alongside the respective flange from which it extends, the outside surface of the respective flange facing the respective reverse bend flange;

a detent in each of said reverse bend flanges;

a gap defined by and between said reverse bend flange and said outside surface of the respective flange from which it extends;

said coupler having first and second ends;

a first end of said connected coupler flanges of said coupler operatively engaging the flanges of said first post member with said reverse bend flanges extending outwardly around elongated edges of said first post member;

a second end of said connected coupler flanges of said coupler operatively engaging the flanges of said second post member with said reverse bend flanges extending outwardly around elongated edges of said second post member;

said coupler coupling said first and second post members in a vertically oriented composite post;

each of said post member flanges comprising a plurality of apertures, said coupler further comprising a plurality of apertures, each said aperture of said coupler being aligned with one of said apertures of said post member flanges for passage of a fastener through said aperture of said coupler and the respective, aligned one of said apertures of said post member flanges; and said detents respectively engaging one of said angularly-formed post members and holding said coupler thereon.

6. In a shelving unit, at least two angularly formed vertically oriented and aligned posts, each having two post flanges disposed at an angle to each other with each post flange having a thickness and an elongated edge, an end of one post proximate an end of another post, and a post coupler for coupling together ends of said posts, wherein said coupler comprises:

a pair of connected coupler flanges, each coupler flange having an interior surface defining an included angle with respect to the interior surface of the other coupler flange, and each coupler flange having an outside surface;

each one of said coupler flanges having a respective additional flange extending from and along edge portions of said coupler flanges;

each said respective additional flange comprising a reverse bend flange extending alongside the respective coupler flange from which the respective reverse bend flange is extended and from proximate but short of one end of said coupler flange to proximate but short of another end thereof, the outside surface of the respective flange facing the respective reverse bend flange;

a detent on each said reverse bend flange;

a gap defined by and between each said respective reverse bend flange and said outside surface of the respective coupler flange from which the reverse bend flange extends, said gap having a width approximately equal to said thickness of a single post member flange, and being sized to accept one of the flanges of a single one of the two angularly formed post members therein, wherein one end of the coupler is configured to receive one of the two angularly formed posts and the other end of the coupler is configured to receive the other one of the angularly formed post members to permit the two post members to be secured in an abutting, end-to-end vertically oriented relationship with one another; and wherein said detents respectively engage a post and hold said coupler thereon.

7. A composite post comprising:

a first angularly formed post member having at least two flanges disposed at an angle to each other, each flange having elongated edges;

a second angularly formed post member having at least two flanges disposed at an angle to each other, said second angularly formed post member being disposed in an abutting, end-to-end vertical relationship with said first angularly formed post member;

a coupler;

said coupler comprising a pair of connected coupler flanges, each having an interior surface defining an included angle with respect to the interior surface of the other flange, and each having an outside surface;

each one of the coupler flanges having a reverse bend flange extending from an edge portion thereof;

each said reverse bend flange extending alongside the respective flange from which it extends, the outside surface of the respective flange facing the respective reverse bend flange;

a detent on each reverse bend flange;

a gap defined by and between said reverse bend flange and said outside surface of the respective flange from which it extends;

said coupler having first and second ends;

a first end of said connected coupler flanges of said coupler operatively engaging the flanges of said first post member with said reverse bend flanges extending outwardly around elongated edges of said first post member;

a second end of said connected coupler flanges of said coupler operatively engaging the flanges of said second post member with said reverse bend flanges extending outwardly around elongated edges of said second post member;

said coupler coupling said first and second post members in a vertically oriented composite post, with said detents engaging a respective post member and holding said coupler thereon.

8. In a shelving unit, at least two angularly formed vertically oriented and aligned end-abutting posts, each having two post flanges disposed at an angle to each other with each post flange having a first thickness and an elongated edge an end of one post proximate an end of another post and a coupler for coupling together ends of said posts to form a composite post, wherein said coupler comprises first and second end portions, a pair of connected coupler flanges, each coupler flange having an interior surface defining an included angle with respect to the interior surface of the other coupler flange, and each coupler flange having an outside surface and elongated edge portions;

each one of said coupler flanges having a respective additional flange comprising a reverse bend flange attached thereto along said edge portion and extending partially along the length of the outer surface of the respective coupler flange from which the respective reverse bend flange is extended and wherein each reverse bend flange extends a length short of the height of the coupler from proximate one end portion of the coupler to proximate another end portion thereof, said end portion in part defining upper and lower end portions of the coupler, each having a central portion of said coupler which is free of said reverse bend flange; wherein the outside surface of the respective flange faces the respective reverse bend flange extending therealong;

a detent on each said reverse bend flange;

a gap defined by and between each said respective reverse bend flange and a respective outside surface of the respective coupler flange from which the reverse bend flange extends, said gap having a width approximately equal to said first thickness of a single post flange and being sized to accept one of the flanges of a single one of the two angularly formed posts therein, wherein one end portion of the coupler is configured to receive one of the two angularly formed posts and the other end portion of the coupler is configured to receive the other one of the angularly formed posts to permit the two posts to be secured in an abutting, end-to-end vertically oriented relationship with one another; and said first and second end portions of said coupler flanges engaging respective flanges of said posts, with said reverse bend flanges of the coupler extending outwardly around elongated edges of respective flanges of said two posts; and said detents respectively engaging a respective post member and holding said coupler thereon.

9. The shelving unit as in claim 8 wherein said unit further comprises a first plurality of detents in at least one of said reverse bend flanges for frictionally engaging said posts to said coupler.

10. The shelving unit as in claim 9 wherein a post engages one of said plurality of detents on said at least one reverse bend flange, said detent engaging an outer surface of one of said post member flanges.

11. The shelving unit as in claim 9 wherein at least one first detent of said plurality of detents in one of each said reverse bend flanges secures said coupler in a position on one of the angularly formed posts.

12. The shelving unit as in claim 11 wherein at least one first detent extends into said gap a further distance than another of said detents.

13. The shelving unit as in claim 8 wherein each of said post flanges includes a plurality of apertures, said coupler further comprising a plurality of apertures, each said aperture of said coupler being aligned with one of said apertures of said post flanges for passage of a fastener through said aperture of said coupler and the respective, aligned one of said apertures of said post flanges.

14. A shelving unit, comprising at least two angularly formed vertically oriented and aligned posts of the same angular configuration, each having two post flanges disposed at an angle to each other with each post flange having a thickness and an elongated edge, an end of one post proximate an end of another post; and a post coupler having two opposed end portions and for coupling together ends of said posts, wherein said coupler comprises:

a pair of connected coupler flanges, each coupler flange having an interior surface defining an included angle with respect to the interior surface of the other coupler flange, and each coupler flange having an outside surface with an end edge;

each one of said coupler flanges having a respective additional flange extending from and along edge portions of said coupler flanges;

each said respective additional flange comprising a reverse bend flange extending alongside the respective coupler flange from which the respective reverse bend flange is extended and from proximate but short of one end edge of said coupler flange to proximate but short of another end edge thereof, the outside surface of the respective flange facing the respective reverse bend flange;

a detent on each reverse bend flange;

a gap defined by and between each said respective reverse bend flange and said outside surface of the respective coupler flange from which the reverse bend flange extends, said gap proximate each end of said coupler, having a width approximately equal to said thickness of a post member flange, and being sized to accept a flange of one of the two angularly formed post members therein, wherein one end portion of the coupler is configured to receive an end of one of the two angularly formed posts and the other end portion of the coupler is configured to receive the end of another one of the angularly formed post members to permit the two similar post members to be secured in an abutting, end-to-end vertically oriented relationship with one another; and said detents respectively engaging at least one of said posts and holding said coupler thereon.

15. A shelving unit having at least two angularly formed vertically oriented and aligned end-abutting posts, each post being of the same angular configuration and having two post flanges disposed at an angle to each other with each post flange having a first thickness and an elongated edge, an end of one post proximate an end of another post and a coupler for coupling together ends of said posts to form a composite post, wherein said coupler comprises first and second end portions, a pair of connected coupler flanges, each coupler flange having an interior surface defining an included angle with respect to the interior surface of the other coupler flange, and each coupler flange having an outside surface and elongated edge portions;

each one of said coupler flanges having a respective additional flange comprising a reverse bend flange attached thereto along said edge portion and extending partially along the length of the outer surface of the respective coupler flange from which the respective reverse bend flange is extended and wherein each reverse bend flange extends a length short of the length of the coupler from proximate one end portion of the coupler to proximate another end portion thereof, said end portion in part defining upper and lower end portions of the coupler, each having a central portion of said coupler which is free of said reverse bend flange; wherein the outside surface of the respective flange faces the respective reverse bend flange extending therealong;

at least one detent on each respective reverse bend flange;

a gap defined by and between each said respective reverse bend flange and a respective outside surface of the respective coupler flange from which the reverse bend flange extends, said gap having a width approximately equal to said first thickness of a single post flange and being sized to accept one of the flanges of a single one of the two angularly formed posts therein, wherein one end portion of the coupler is configured to receive one of the two angularly formed posts and the other end portion of the coupler is configured to receive the other one of the angularly formed posts to permit the two posts to be secured in an abutting, end-to-end vertically oriented relationship with one another;

said first and second end portions of said coupler flanges engaging respective flanges of said angular posts, with said reverse bend flanges of the coupler extending outwardly around elongated edges of respective flanges of said two posts; and each said detent engaging a respective angularly-formed post and holding said coupler thereon.

* * * * *